US007743558B2

(12) United States Patent
Jakob-Bamberg et al.

(10) Patent No.: US 7,743,558 B2
(45) Date of Patent: Jun. 29, 2010

(54) DOUBLE SLIDING DOOR

(75) Inventors: Rupert Jakob-Bamberg, Calgary (CA); Nolan McRae, Calgary (CA); Kevin Bagnall, Calgary (CA); Luke Fabian Smith, Calgary (CA); Vincent Shivak, Calgary (CA); Steven McIlvenna, Calgary (CA)

(73) Assignee: Haworth, Ltd., Calgary, Alberta (CA)

( * ) Notice: Subject to any disclaimer, the term of this patent is extended or adjusted under 35 U.S.C. 154(b) by 804 days.

(21) Appl. No.: 11/644,190

(22) Filed: Dec. 22, 2006

(65) Prior Publication Data

US 2008/0148639 A1 Jun. 26, 2008

(51) Int. Cl.
*E05D 13/00* (2006.01)
*E05D 15/06* (2006.01)
*E05D 15/16* (2006.01)

(52) U.S. Cl. ..... 49/409; 49/425; 52/207; 52/223.1

(58) Field of Classification Search ..... 52/223.1, 52/204.2, 207, 243.1, 205; 49/116, 118, 49/119, 120, 366, 370, 409; 160/196.1, 199, 160/200

See application file for complete search history.

(56) References Cited

U.S. PATENT DOCUMENTS 3,834,081 A * 9/1974 Catlett ..... 49/360
4,475,313 A * 10/1984 Governale ..... 49/370
4,656,781 A * 4/1987 Niekrasz et al. ..... 49/404
5,152,113 A * 10/1992 Guddas ..... 52/238.1
6,360,487 B1 * 3/2002 Kern et al. ..... 49/231
2004/0083653 A1 * 5/2004 Delgado et al. ..... 49/120

* cited by examiner

*Primary Examiner*—David Dunn
*Assistant Examiner*—Benjamin Pevarski
(74) *Attorney, Agent, or Firm*—Flynn, Thiel, Boutell & Tanis, P.C.

(57) ABSTRACT

A double sliding door arrangement cooperating with a double-wide door opening formed in an upright wall. A top header beam extends across and defines the upper extremity of the door opening. A pre-tensioning arrangement mounted on and extending lengthwise of the top header beam causes the header beam to be deflected upwardly into a shallow bowed shape. A support track is fixed to and extends lengthwise of the header beam and horizontally for predetermined distances along and rigidly fixed to the wall adjacent right and left sides of the door opening. Right and left slab doors are supported on and vertically suspended downwardly from said track in sidewardly co-planar relationship, and are movable along said track between closed and open positions. The doors in the closed position vertically load and downwardly deflect the header beam, whereby the initial upwardly bowed shape minimizes outward swinging between opposed inner edges of the doors when in the closed position.

9 Claims, 11 Drawing Sheets

DOUBLE SLIDING DOOR

FIELD OF THE INVENTION

This invention relates to an upright interior wall system having an improved double sliding door arrangement associated therewith.

BACKGROUND OF THE INVENTION

Prefabricated upright wall systems are frequently utilized for dividing large interior spaces into a plurality of smaller spaces such as offices, hallways, conference rooms and the like. Such wall system, where a higher degree of privacy is desired, is frequently of the full-height variety in which the wall panels and the wall defined thereby is about eight to ten feet high. However, the upper edge of the wall is typically spaced downwardly from the building ceiling, with the wall having no significant structural connection to the ceiling other than possible use of small braces which provide solely limited horizontal lateral support. These full-height wall systems typically include doorways for accessing various areas or regions, such as workspaces and conference rooms. To increase privacy, the wall system is frequently provided with a sliding door positioned laterally adjacent one side of the wall and supported from an overhead track secured to the wall for movement between a closed position wherein the door extends across the door opening, and an open position wherein the door is sidewardly displaced from the door opening and laterally overlies one side of an adjacent wall section. Because of the overall construction and manner of support of such wall systems, and specifically the fact that the upper header structures which extend along the wall and across the doorway are spaced downwardly from the ceiling and are free of any direct vertical structural support therewith, and are also readily visible, the overall design and structural characteristics of the header structure, and specifically the header which extends across the doorway and along the associated door support track, have long presented problems with respect to structural design thereof so as to minimize size, weight and overall complexity, particularly with respect to supporting a sliding door, while at the same time providing desired aesthetics. These design problems become of greater significance in wall systems wherein the wall panels are defined by open frames which support large glass slabs as the dominant upright panel structure, and wherein the sliding door is defined by a heavy glass slab which mounts a roller arrangement on the upper edge for horizontal rolling support along a guide track which is fixed to and extends horizontally lengthwise along the doorway and adjacent wall panel headers.

A full-height wall system of this latter type, namely a system wherein a sliding door is defined by a glass slab which is rollingly supported from a track which is fixed to and extends along the doorway header, is disclosed in co-pending application Ser. No. 11/450,908 (filed Jun. 9, 2006) as owned by the Assignee hereof. The disclosure of this latter application, in its entirety, is incorporated herein by reference.

While the wall system and specifically the sliding door arrangement disclosed in aforementioned application Ser. No. 11/450,908 is believed to provide a desirable solution with respect to both structural and aesthetic aspects associated with the design of a sliding door for a prefabricated upright wall system, particularly a system employing a glass panel door, nevertheless there still exists a need for an improved sliding door arrangement and specifically an improved doorway header capable of supporting a door arrangement defined by a double sliding door. More specifically, when one provides a double sliding door in a prefabricated full-height wall system, the width of the doorway or door opening is effectively doubled, that is a width of about eight feet in comparison to the typical four foot width associated with a typical single sliding door. The door header hence must have significantly increased length corresponding to the width of the double doorway and, since the doorway header is vertically supported solely at its ends, the increased length or span of the doorway header makes the header more susceptible to vertical deflection under load, absent substantial additional strengthening or stiffening of the header. In addition, the deflection associated with the long doorway header is further compounded by the fact that the header is subjected to a significantly greater load, namely the load imposed thereon due to the weight of two heavy glass doors when the doors are supported from the header and are positioned in direct sidewardly adjacent relationship so as to close off the double wide door opening. The substantial doubling of the length of the door header, coupled with the substantial doubling of the load imposed thereon by the double doors, hence significantly increases problems associated with structural design of the header and the resulting aesthetics thereof, while at the same time minimizing deflection of the header under load. In particular, such deflection can seriously impair or destroy the overall aesthetics, particularly when the two doors are in a closed position, since any significant downward deflection or bowing of the header causes the doors to swing or skew outwardly away from one another, thereby creating an irregular visible gap between adjacent side edges of the doors, particularly adjacent the lower extremities of the doors.

Accordingly, it is an object of this invention to provide an improved double sliding door arrangement for an upright wall system, which double sliding door arrangement provides significant improvements with respect to compensating for deflection of the doorway header so as to provide significantly improved aesthetics when the double doors are in a closed position, whereby adjacent opposed inner side edges of the double doors when in the closed position define a relatively uniform vertical reveal line or gap therebetween.

In the improved double sliding door arrangement of the present invention, the door header is provided with a reinforced header beam which is pre-stressed to have a slight upward deflection or bow when in a non-loaded condition, that is, when the doors are in an open position and supported on segments of the roller track which are supported on the wall panels disposed on opposite sides of the doorway. When the doors are moved into the closed position and impose their weight load on the roller track carried on the doorway header, however, the pre-stressed header beam is deflected downwardly. This load-induced deflection initially overcomes the upward pre-stressed deflection so that the beam initially moves into a straight condition, with the load causing the beam to continue deflecting downwardly into a downwardly bowed configuration. The overall downward deflection of the doorway header beam due to loading thereof by the double sliding glass doors is generally of a magnitude such that the beam deflects downwardly below a straight condition by a magnitude no greater than the pre-stressed upward deflection above the straight condition. The downward bowing from the straight condition under a fully loaded condition is hence minimized to a sufficiently small magnitude so that the sidewardly-adjacent closed doors do not experience less outward swinging away from one another, thereby preserving desired aesthetics with respect to the opposed adjacent vertical side edges of the closed doors.

In the improved double sliding door arrangement of the present invention, as aforesaid, the overall door arrangement preferably includes roller support units mounted adjacent opposite upper corners of each door for rollingly supporting the door on the overhead support track. Each roller support unit preferably includes a vertical adjustment capability which enables its respective roller to have at least limited vertical positional adjustability relative to an upper edge of the door to improve aesthetics and to compensate for deflection of the doorway header beam under load. The two roller units on each door can be adjusted differently so that the rollers closest to the inner vertical edges of the doors are slightly lower. While this may cause the doors when in the open position to have a very small inward angled displacement toward one another, such angular displacement is not noticeable when the doors are widely spaced apart (i.e. in the open position) and are disposed in overlying relationship to the respective wall panels. As the doors move toward the closed position and effect loading and consequent downward deflection of the doorway header beam, however, this slight inward angular displacement of the doors due to the different positional adjustments in the door support rollers compensates for downward deflection of the door header beam below the straight condition, since this latter downward deflection tends to angularly swing the pair of doors outwardly away from one another so as to position the opposed inner upright edges of the two doors, when in the closed position, directly adjacent one another in substantially parallel relationship to thereby provide an improved and pleasing aesthetics.

Other objects and purposes of the invention will be apparent to persons familiar with constructions of this general type upon reading the following specification and inspecting the accompanying drawings.

Figure 1:
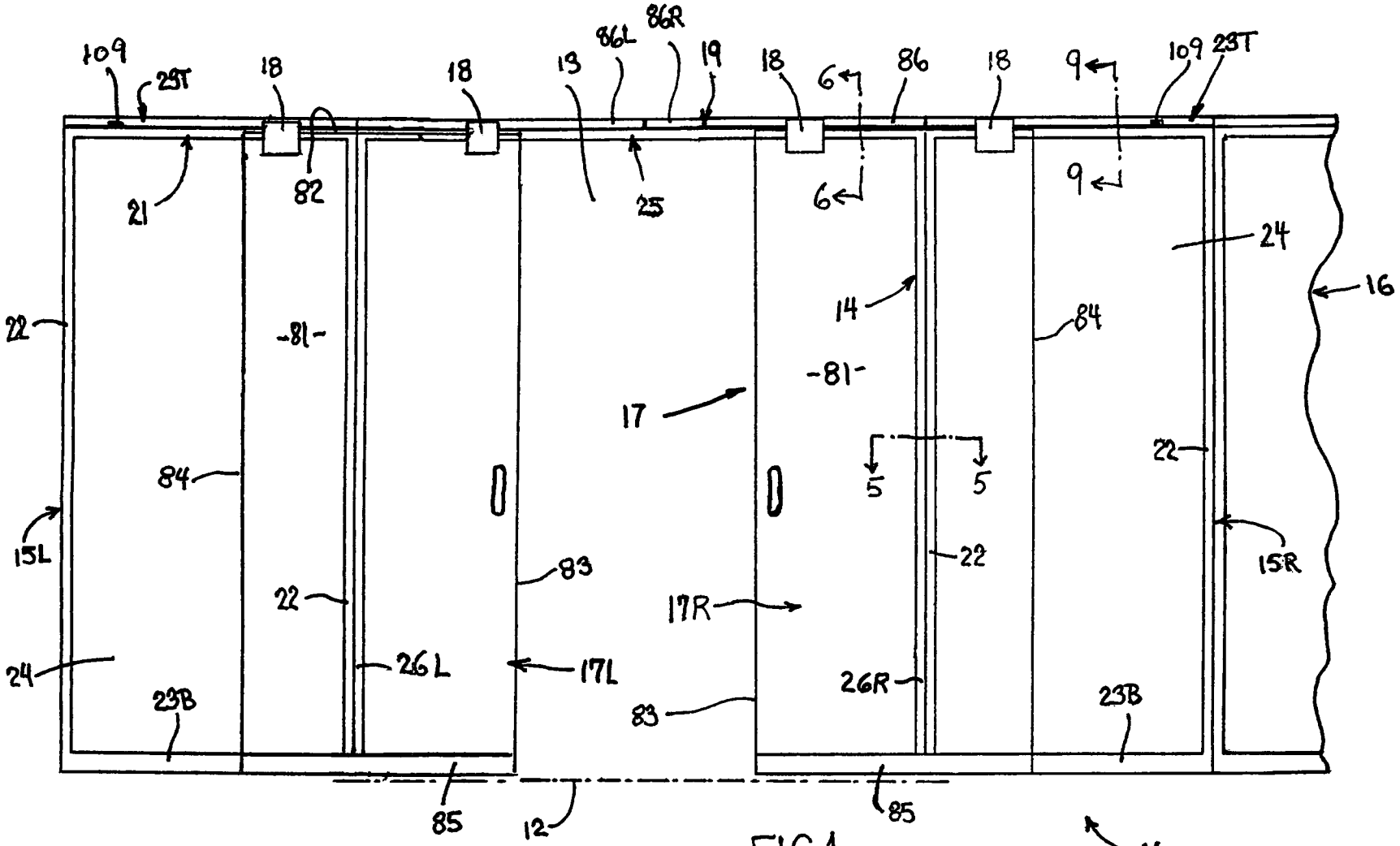
FIG. 1 is a side elevational view of a full-height wall system incorporating an improved double sliding door arrangement according to the present invention.

Certain terminology will be used in the following description for convenience and reference only, and will not be limiting. For example, the words "upwardly", "downwardly", "rightwardly" and "leftwardly" will refer to directions in the drawings to which reference is made. The words "upwardly" and "downwardly" will also be used in their conventional sense to indicate the orientation of the wall structure and door assembly relative to the floor and ceiling with which they are associated. The words "front" or "outer" will be used to reference the exposed side of the door which is always visible, irrespective of whether the door is in its open or closed position, and the words "back" or "inner" will be used to refer to the side of the door assembly which directly confronts and overlaps the wall when the door is in an opened position. The words "inwardly" and "outwardly" will refer to directions toward and away from, respectively, the geometric center of any referenced assembly or any referenced part thereof. Said terminology will include the words specifically mentioned, derivatives thereof, and words of similar import.

DETAILED DESCRIPTION

Referring to FIG. 1, there is illustrated a prefabricated upright wall system 11 which is intended for support on a floor 12 within a building, and which cooperates with additional fixed or prefabricated movable walls to assist in dividing a large open area into smaller areas used for offices and the like. The upright wall system 11 in the illustrated arrangement has a doorway 13 associated therewith for permitting passage between adjacent areas, such as between a hallway and an adjacent office, conference room or other area. The doorway or passage 13, in the present invention, is of double width and is defined by an inverted U-shaped door frame 14 disposed in sidewardly aligned relationship with, and joined to, a pair of sidewardly adjacent upright wall panels 15R and 15L, one of which is shown joined to an additional upright wall panel 16. The upright wall system 11 has a vertically suspended sliding door arrangement 17 associated therewith. The sliding door arrangement 17 is disposed in laterally adjacent and generally overlapping relationship to one exposed side, herein referred to as the front side, of the upright wall. The sliding door arrangement 17 includes a pair of sliding doors, namely right and left sliding doors designated 17R and 17L, positioned in generally sidewardly adjacent relationship and each being independently horizontally movable in the elongated direction of the wall between a closed position wherein the two doors are directly sidewardly adjacent and wholly overlap and close off the doorway 13, and an open position wherein the doors are displaced sidewardly in opposite directions away from one another so that a significant majority of each door 17R and 17L sidewardly overlaps the respective sidewardly adjacent wall panel 15R and 15L. The doors 17R and 17L are illustrated in FIG. 1 in a partially open position.

The suspended sliding doors 17R and 17L each have a pair of roller hanger units 18 mounted adjacent the upper edge thereof, in the vicinity of the opposite upper corners of the door. The roller hanger units 18 as mounted on the upper edge of each door are typically substantially identical except for being right and left units (i.e., mirror images of one another).

The roller hanger units cooperate with a horizontally elongate track or rail arrangement 19 which is mounted on and extends horizontally along the upper edge of both the door frame 14 and the adjacent side panels 15R and 15L, as described hereinafter, so as to support the doors 17R and 17L in vertically suspended relationship adjacent the front side of the upright wall.

Each of the wall panels 15R and 15L, in the illustrated and preferred construction, is a prefabricated arrangement defined by a ring-like outer frame 21 having a pair of generally parallel and sidewardly spaced vertically frame elements 22 which at opposite ends are rigidly joined by generally horizontally extending and generally parallel top and bottom frame elements 23T and 23B so as to define a generally rigid structure. This frame 21 in turn supports therein a large sheet-like, upright center panel 24 which, in the preferred construction, comprises at least one large glass pane, typically a transparent sheet of glass, the edges of which are supported in a conventional manner on the horizontal and vertical frame elements 22 and 23. The construction of such prefabricated upright wall panels, particularly those commonly known as "glass" panels due to the main center portion of the panel being constructed of glass, is known in the art, and further description thereof is believed unnecessary.

Figure 2:
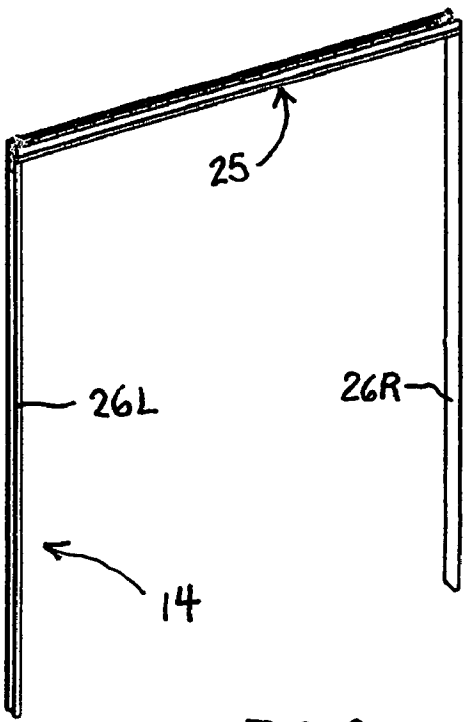
FIG. 2 is a perspective view of solely the assembled doorway frame as incorporated into the wall system of FIG. 1.
Figure 3:
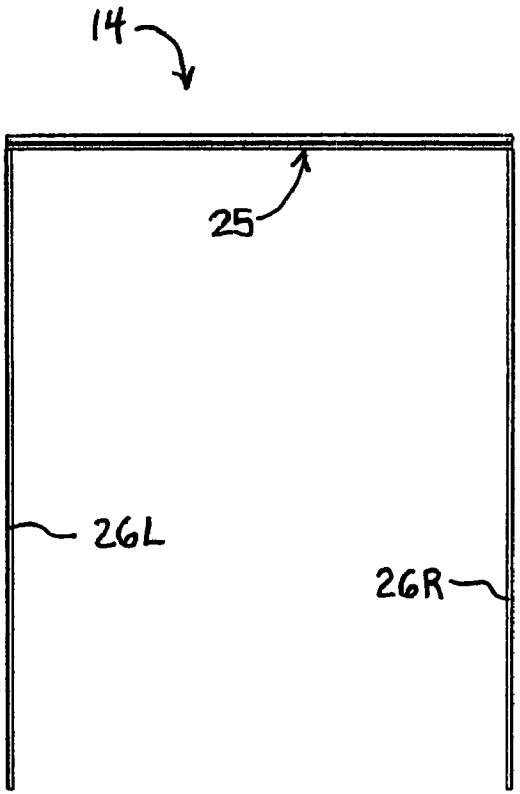
FIG. 3 is a side elevational view of the assembled doorway frame shown in FIG. 2.
Figure 5:
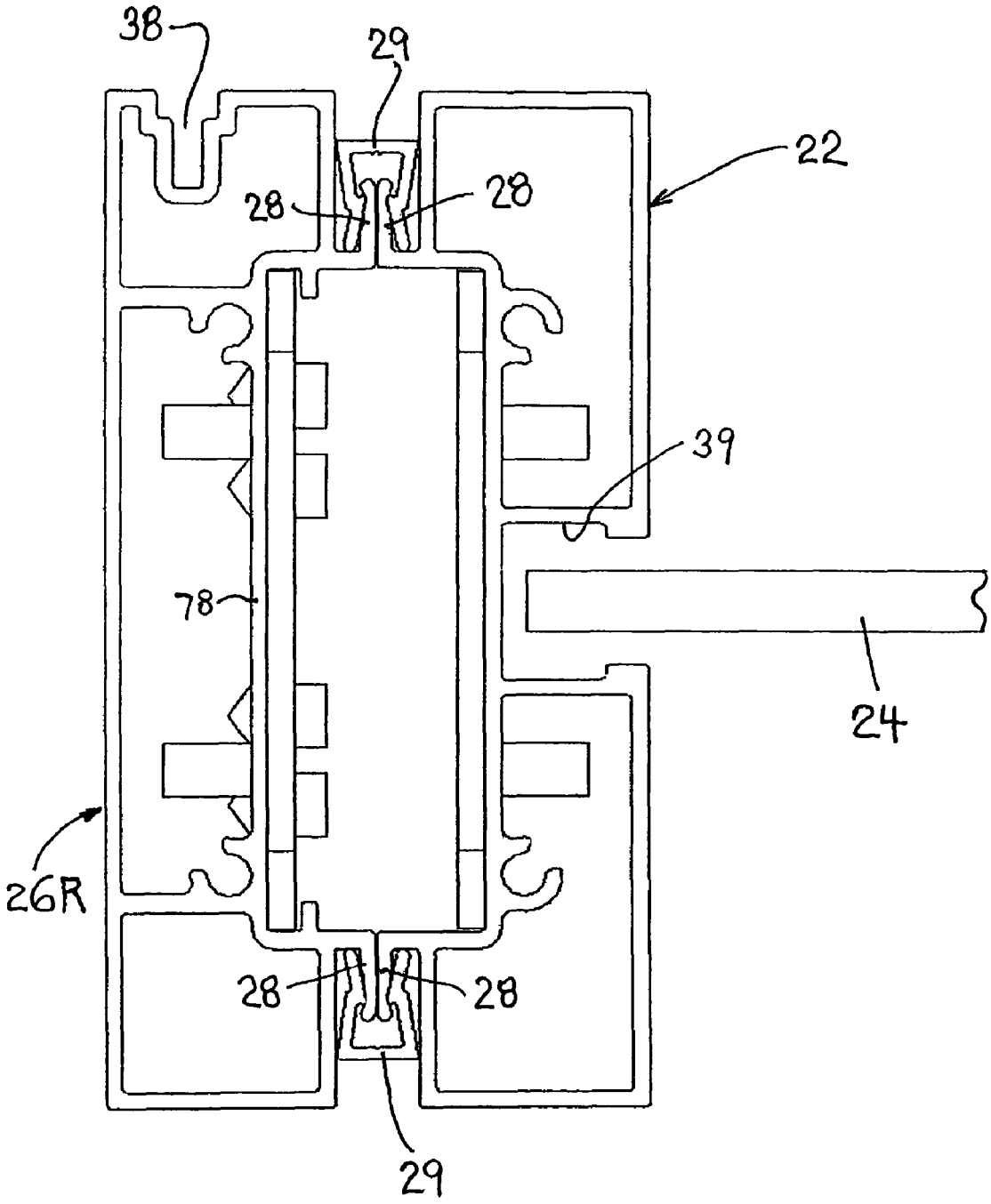
FIG. 5 is an enlarged fragmentary cross-sectional view taken generally along line 5-5 in FIG. 1 and illustrating solely the structural cooperation between the upright frame element of the doorway and its cooperation with the upright frame element of the adjacent wall panel.

In accordance with the present invention, the double-width door frame 14 which rigidly joins between the spaced edges of adjacent wall panels 15R and 15L, as illustrated by FIGS. 2-3, is defined by generally parallel and sidewardly spaced door frame uprights 26R and 26L which are directly rigidly joined together solely at the upper ends thereof by a horizontally extending structural doorway header 25. This structural doorway header 25 defines the upper extremity of the door opening 13, and is generally horizontally aligned with the upper horizontal frame elements or headers 23T of the adjacent wall panels 15R and 15L. In addition, in the illustrated arrangement as shown in FIGS. 1 and 5, the door frame uprights 26 abut the adjacent vertical side frame uprights 22 of the adjacent wall panels, which frame and panel uprights have edge flanges 28 (FIG. 5) which substantially abut. These edge flanges 28 in turn have a vertically elongate channel-shaped clamping strip 29 engaged thereover so as to hold the adjacent vertical uprights in secure abutting engagement with one another. The clamping strips 29 have deflectable legs which create a snug clamping engagement with the overlapping flanges 28, but at the same time allow limited relative vertical positional adjustment between the adjacent frame uprights. Such clamping strips and their cooperation between adjacent upright frames is known in the art. It will also be appreciated that other types of connecting structures can be utilized for joining the adjacent frame uprights.

With respect to the construction of the doorway header 25 which spans across the upper edge of the door opening 13, and which bears the weight (i.e. load) of the sliding doors 17R and 17L when the doors are in the closed position, this doorway header 25 is of a composite structure defined by a plurality of horizontally elongate members which extend across the upper edge of the doorway opening and are rigidly joined together. More specifically, in the illustrated embodiment, this doorway header 25 constitutes a composite beam which includes a horizontally elongate header member 31, the latter having an elongate channel-shaped reinforcing beam 32 supported on top thereof, an upper frame beam 33 being seated on top of and within the reinforcing beam 32 and extending lengthwise therealong, and a lower frame beam 34 being positioned within the hollow interior of the header beam 31 and extending lengthwise therealong. The upper and lower frame beams 33 and 34 are each of tubular cross-section, and these upper and lower frame beams 33 and 34 are rigidly joined together so that horizontal walls associated with the reinforcing beam 32 and the header beam 31 are rigidly sandwiched therebetween. The four members or beams 31-34 hence define a rigid one-piece composite beam which extends horizontally across the width of the door opening 13.

Figure 7:
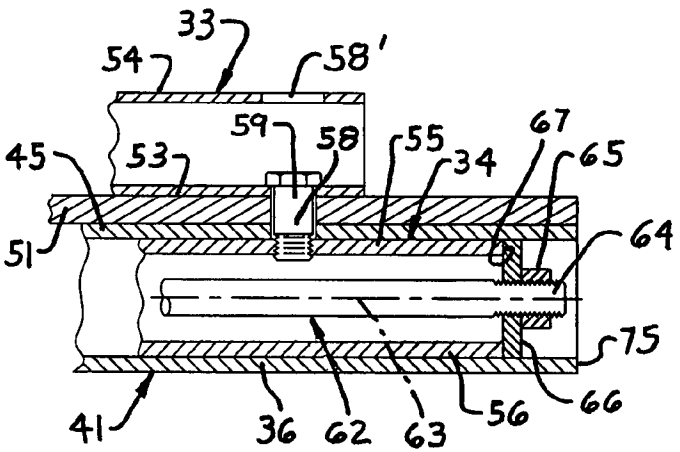
FIG. 7 is a fragmentary sectional view taken generally along line 7-7 in FIG. 6.
Figure 6:
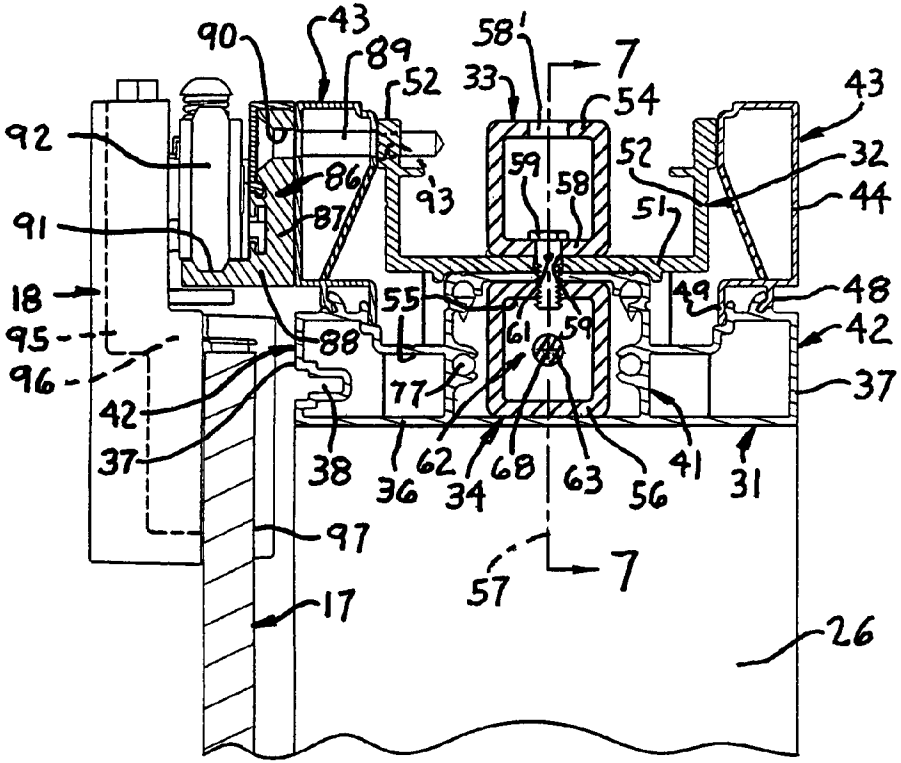
FIG. 6 is an enlarged, fragmentary cross-sectional view taken generally along line 6-6 in FIG. 1 and illustrating the construction of the doorway header and its cooperation with the upper edge of the sliding door.
Figure 8:
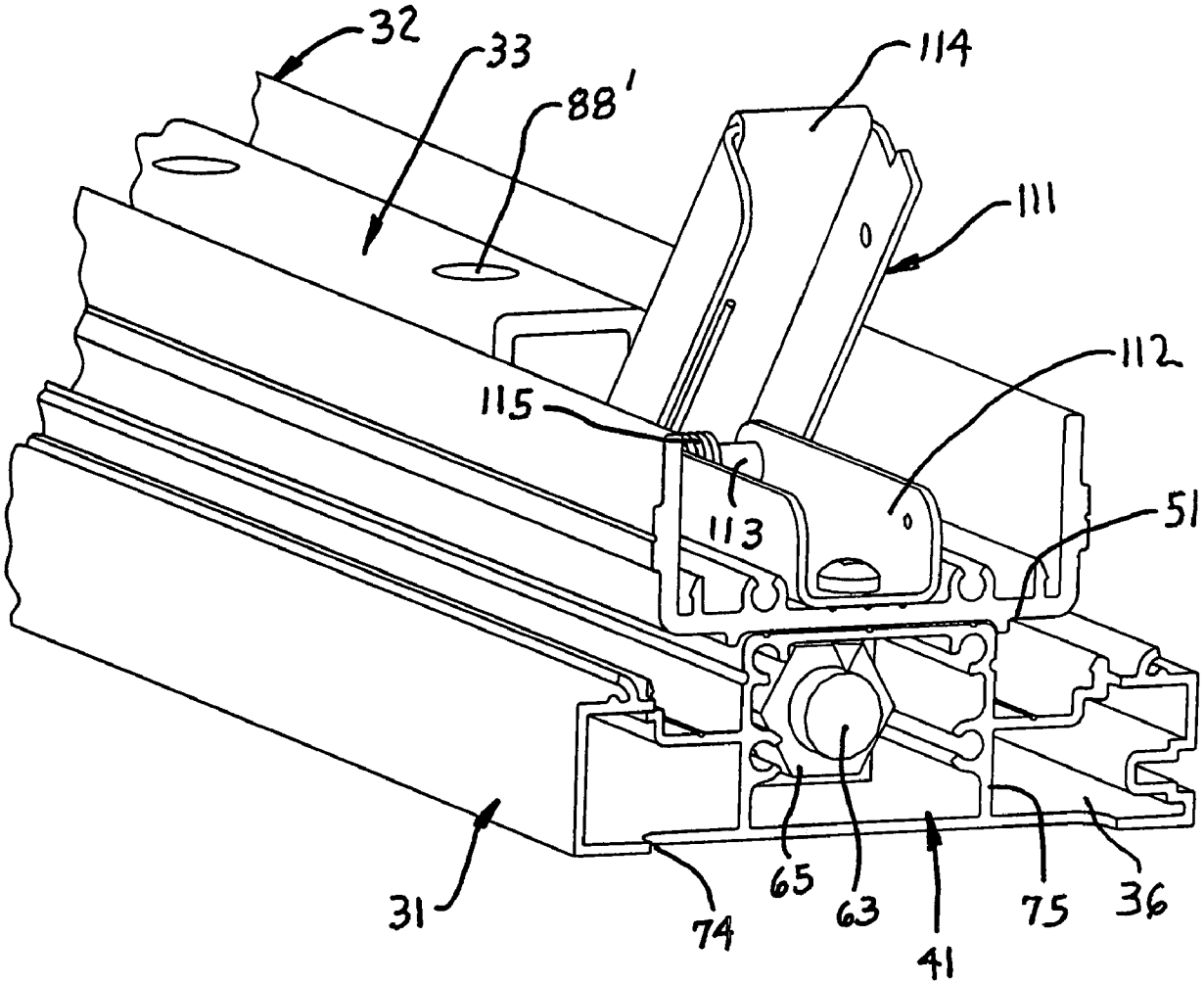
FIG. 8 is a fragmentary perspective view showing one end of the doorway header beam.

Considering now the construction of the doorway header beam 25 in greater detail, and referring specifically to FIGS. 6-8, the horizontally elongate header member 31 has a lower horizontal wall 36, the latter defining the upper extremity of the doorway opening 13. The bottom wall 36 at opposite edges joins to upwardly protruding side walls 37, which side wall 37 adjacent the front side of the wall structure has a channel 38 extending horizontally throughout the length thereof for accommodating therein a seal strip (not shown) such as a brush or the like which is adapted to protrude outwardly for engagement with the back side of the door to create an acoustical seal.

The header member 31 preferably has a tubular cross-section for strength and rigidity purposes, and in the illustrated arrangement includes a generally box-shaped tubular center part 41 which protrudes upwardly from the bottom wall 36, and which is positioned sidewardly between a pair of tubular edge parts 42, the latter being defined in part by the bottom wall 36 and the respective side wall 37. This header member 31 is preferably formed as an elongate aluminum extrusion.

The header member 31 mounts thereon upper trim members 43 which are carried on and protrude upwardly from the respective tubular edge parts 42. The trim members 43 are horizontally elongate so as to extend lengthwise along the full length of the structural doorway header 25. Each trim member 43 includes a vertical side face 44 which is substantially co-planar with the side leg 37 of the header member 31. The trim member 43 at its lower end defines a hook 48 which protrudes downwardly therefrom and an inner cantilevered leg part 49 which also protrudes downwardly. The hook 48 and leg 49 cooperate with opposed hooks and shoulders defined on the tubular edge part 42 of the header member 31 so that the trim members 43 can be engaged with the hooks on the tubular edge parts 42 and then rotated into an upright position substantially as illustrated in FIG. 6 so as to create a rigid snapped engagement with the header member 31.

Regarding the reinforcing beam 32 as associated with the structural doorway header 25, this reinforcing beam 32 in the illustrated embodiment is defined by a generally upwardly-opening channel or U-shaped member having a bottom wall 51 which seats on the upper wall 45 of the center tubular part 41 and is rigidly joined thereto, as described below. This reinforcing beam 32 also has generally parallel side walls or legs 52 which are cantilevered upwardly from opposite side edges of the base wall 51. The side legs 52 are generally provided with pads which effectively abut the rear inner surfaces of the tubular parts associated with the upper trim members 43.

The channel-shaped reinforcing beam 32 is preferably an aluminum extrusion, and extends horizontally along the full length of the header beam 31.

The upper frame member 33 has a rectangular tubular cross-section (square in the illustrated embodiment), and this tubular beam 33 is sized so as to be positioned within the interior of the channel-shaped reinforcing beam 32. In this regard, the bottom wall 53 of the upper frame beam 33 is seated directly on and fixedly joined (as described hereinafter) to the bottom wall 51 of the reinforcing beam 32, with the upper frame beam 33 protruding upwardly therefrom. The overall height of the upper frame beam 33 is selected, however, so that the top wall 54 thereof does not significantly protrude above the upper edge of the side walls 52 of the reinforcing beam, and hence this top wall does not protrude above the upper edges of the trim members 43. In the illustrated arrangement the top wall 54 is approximately level with the upper edges of the side walls 52. The upper frame beam 33 preferably extends substantially the full length of the reinforcing beam 32.

The lower frame member 34 is also preferably of a rectangular tubular cross-section, namely a square tubular cross-section in the illustrated embodiment, and is sized so as to be positionable within the open interior of the box-shaped center part 41 of the header beam 31. The configuration of the lower frame member 34 is preferably selected so as to maximum the height thereof, and thus the top wall 55 thereof is positioned directly under the top wall 45 of the box-shaped center part 41, and the bottom wall 55 of the beam 34 substantially rests on the bottom wall of the box-shaped center part 41, with the overall height of the tubular lower beam 34 being selected to permit this beam to be readily slidably inserted into the interior of the box-shaped center part 41. The tubular lower frame beam 34 has a length which substantially corresponds to the overall length of the header beam 31 except that the length of lower frame beam 34 is slightly shorter so that the ends (as indicated by the end face 67 in FIG. 7) are spaced inwardly a small distance from the respective adjacent exposed end 75 of the header beam 31.

The beams 31-34, when vertically stacked together in the arrangement described above and as illustrated in FIG. 6, are all sidewardly centered relative to an upright (i.e. vertical) center plane 57 which extends lengthwise of the composite beam. The bottom wall 53 of the upper frame beam 33 and the top wall 55 of the lower frame beam 34, as well as the interposed bottom wall 51 of the reinforcing beam 32 and the top wall 45 of the box-shaped center part 41 all have a lengthwise-extending row of openings 58 extending transversely (i.e. vertically) therethrough, with the openings in the row being disposed in closely adjacent relationship, with a spacing between adjacent openings preferably being no more than about eight inches apart, and preferably in the range of about three inches to about six inches apart. Fasteners such as screws 59 extend through the aligned openings, as illustrated in FIG. 5, so as to rigidly join all of the beams 31, 32, 33 and 34 together at a large number of closely-spaced locations in the lengthwise extent of the beam, thereby providing a high degree of rigidity while enabling the composite beam to be fabricated from individual elongate members. The openings associated with the top wall 55 of the lower frame beam 34 are preferably threaded so as to be threadably engaged with the screws 59 to effect the desired rigid securement. In addition, the top wall 54 of the upper frame beam 33 is preferably provided with enlarged openings 58' which are aligned above the screws 59 so as to provide access thereto. The construction of the composite header beam 25, when defined from the fixedly secured beams 31, 32, 33 and 34 as described above, results in the centroid (i.e. center of gravity) of the composite beam being located within the center plane 57 at a location adjacent and preferably above the top wall 45 of the box-shaped center part 41 of the header beam 31. The centroid is diagrammatically illustrated at 61 in FIG. 6.

In accordance with the present invention, the structural doorway header 25 has a pre-tensioning structure 62 associated therewith to permit a small upward deflection, that is, a small upward bowing of the composite header beam 25 as the beam extends between its opposite free ends, which pre-tensioning of the beam maintains it in this upwardly-bowed configuration prior to imposition of external door loads thereon.

More specifically, this pre-tensioning structure 62 includes an elongate tensioning rod 63, such as a cylindrical steel rod, which is positioned within the interior of the lower frame beam 34 and extends lengthwise thereof. The tensioning rod 63 has a length which at least slightly exceeds the overall length of the lower frame beam 34 so that threaded ends 64 as defined on opposite ends of the tensioning rod 63 protrude outwardly beyond the respective end face 67 of the beam 34, as illustrated in FIG. 7. The end of the rod 63 passes through an opening formed in an end plate 66, the latter being disposed to abut the beam end face 67. Each threaded end 64 of rod 63 has a nut 65 rotatably threaded thereon, the latter being suitably tightened so as to bear against the end plate 66 and hence maintain the latter in proper abutting engagement with the end face 67 of beam 34. By suitable tightening of the nuts 65 into snug compressive engagement against the end plates 66, which in turn are compressed against the opposite free end faces 67 of the beam 34, a tension force is created in the tensioning rod 63, whereas a compression force is exerted against opposite free ends of the lower frame beam 34, which opposed tension and compression forces effectively act along the longitudinal centerline 68 of the rod 63, which centerline also corresponds to the longitudinal centerline of the beam 34 inasmuch as the end plates 66 maintain the rod 63 centrally positioned within the interior of the beam 34. The centerline 68 is generally parallel with but disposed downwardly a substantial distance below the centroid 61, whereby the compression force acting on the lower frame beam 34 along the centerline 68 hence causes the elongate composite beam 25 to deflect upwardly into an upwardly bowed configuration (i.e. a downward-facing concave configuration). The magnitude of the upward deflection, which is a maximum at the center or midpoint between the ends of the beam, is a function of the magnitude of the force generated in the tensioning rod 63. The upward deflection at the midpoint of the beam is normally maintained at a relatively small amount, such as in the order of six millimeters or less, and preferably about three millimeters, so that the composite beam 25 when in this pre-stressed deflected condition does not present any significant bowed or arc-shaped appearance when viewed from opposite sides thereof.

The assembly of the composite beam and the pre-stressing thereof into its upwardly deflected condition is preferably carried out prior to assembly of the beam into the wall system, and in fact is preferably carried out by pre-assembling and pre-stressing the beam in the factory, prior to shipment to the job site, so as to permit precise control of the pre-stressing and of the magnitude of beam deflection.

Figure 4:
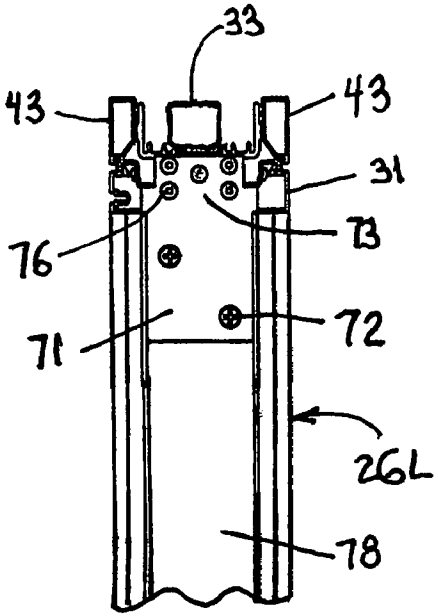
FIG. 4 is an enlarged end view which illustrates one end of the doorway header beam and its fixed attachment to an upper end of the doorway upright frame element.

To secure the horizontally elongate doorway header beam 25 to upper ends of the door frame uprights 26R and 26L, the header is positioned so that the ends thereof effectively rest on the upper exposed ends of the uprights 26R and 26L substantially as illustrated in FIG. 3. Each end of the header beam 25 is then rigidly secured to the respective upright 26R or 26L by a vertical securing plate (FIG. 4) which is positioned in overlapping engaged relationship with a transverse web wall 78, with the securing plate 71 being fixed to the web wall 78 by a plurality of fasteners such as screws 72. The securing plate 71 has an upper plate part 73 which protrudes upwardly beyond the upper extremity of the respective upright and vertically overlaps at least the exposed end of the box-shaped center part 41 of the main header beam 31. This upper plate part 73 is then fixedly and rigidly secured to the end of the main header beam 31 by a plurality of fasteners such as screws 76 which project through openings in the plate part 73 and are engaged within screw-accommodating recesses 77 (FIG. 6) which are formed around the inner periphery of the box-shaped center part 41 and which project inwardly from the free end thereof.

The free end of the main header beam 31 can be provided with a shallow recess 74 (FIG. 8) formed in the end face thereof, which recess is sized so as to accommodate the width and thickness of the plate part 73, whereby the plate part 73 when viewed from the side of the wall is effectively hidden behind the outer portions of the header beam 31 and the trim members 43 which are mounted on and extend lengthwise thereof.

To provide the wall system of this invention with desirable aesthetics, and consistent appearance specifically along the header structure which extends lengthwise along the upper edge of the wall, the top frame or header beams 23T which are associated with and extend along upper edges of adjacent side panels 15R and 15L are provided with an external appearance (when viewed from the side) which is substantially identical to the sideward appearance presented by the doorway header 25. This substantial identity of appearance is achieved by use of many of the same or substantially the same elongate members which cooperate to define the doorway header 25.

Figure 9:
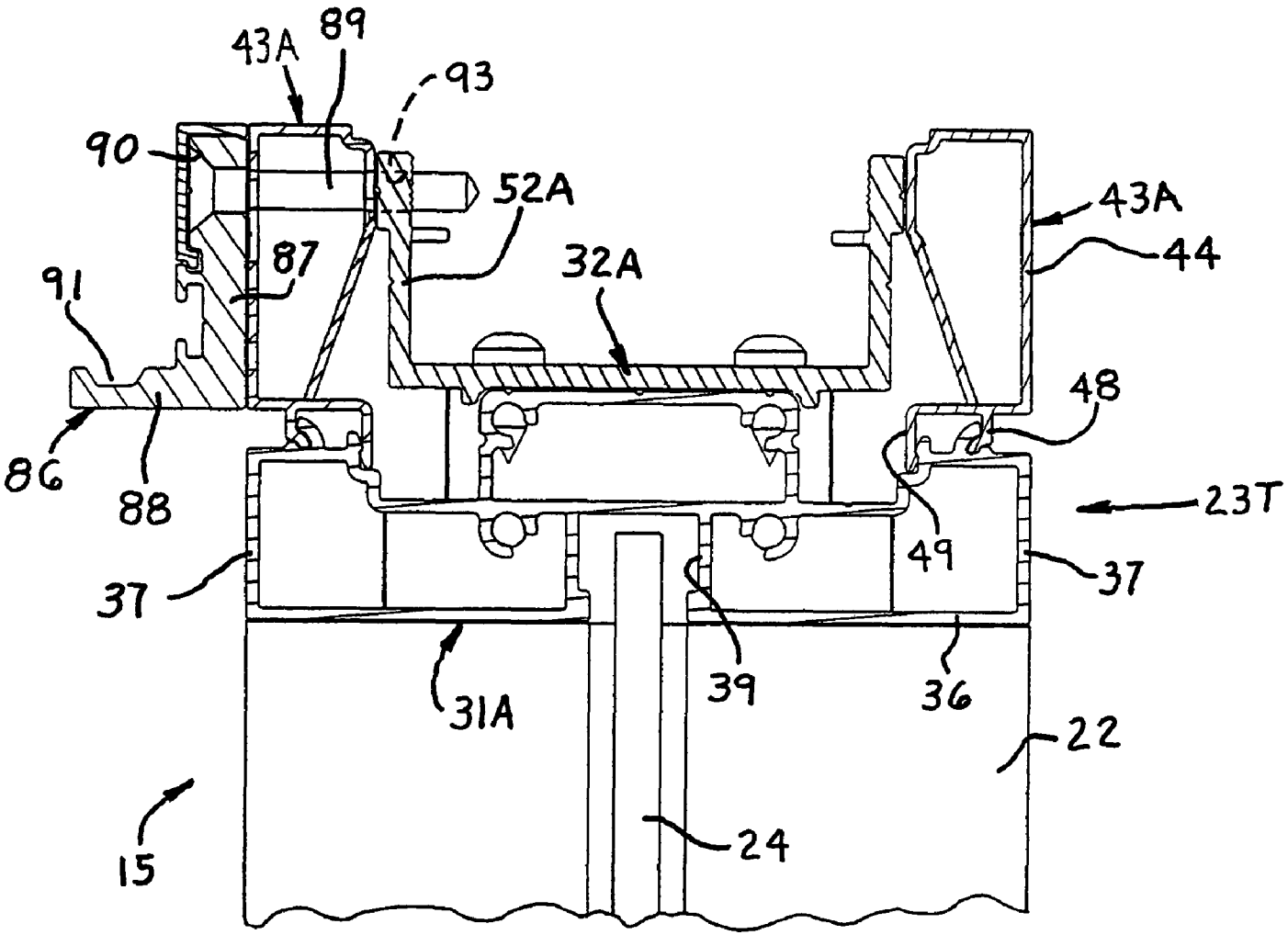
FIG. 9 is an enlarged fragmentary cross-sectional view taken generally along line 9-9 in FIG. 1 and illustrating the header structure of an adjacent wall panel.

More specifically, and referencing FIG. 9, the elongate top frame or header beam 23T as associated with each of the side wall panels 15R and 15L includes a top horizontally elongated frame member 31A which is of a generally closed tubular construction in the preferred embodiment and has a construction and outer profile which generally corresponds to the doorway header beam 31 described above, except that top frame member 31A does not have an acoustical seal strip channel 38 in the side wall thereof, and the top frame member 31A has a downwardly opening channel 39 extending lengthwise along and opening upwardly from the bottom wall, which channel 39 accommodates a respective edge of the center glass panel 24. The channel 39 typically accommodates therein a conventional glazing strip (not shown) which forms a cushioned acoustical seal between the edge of the glass panel and the surrounding frame.

The upper frame beam 23T associated with each of the wall panels 15R and 15L, in addition to the horizontal frame member 31A, also mounts thereon top trim members 43A (FIG. 9) which are substantially identical to the trim members 43 described above and which mount in the same manner as described above relative to FIG. 6.

The side panels 15R and 15L (i.e. the panels which are overlapped by the sliding doors when in an opened position) also have a reinforcing beam 32A (FIG. 9) associated with and extending lengthwise along the top header member 31A. The reinforcing beam 32A is substantially identical in cross-section to the reinforcing beam 32 associated with the doorway header 25, and these beams 32 and 32A are aligned end-to-end when the door frame is assembled in aligned relationship to the adjacent side panels 15R and 15L. This reinforcing beam 32A is positioned sidewardly between the top trim members 43A and is seated on and fixedly secured to the center box portion of the top frame member 31A by a plurality of fasteners, such as screws, which extend between and rigidly join the overlapping horizontal walls of the members 31A and 32A at a plurality of locations spaced lengthwise therealong. The reinforcing beam 32A, like the beam 32 associated with the doorway header, provides significant strength and rigidity to the overall frame header assembly as associated with the respective panel 15R or 15L.

Considering now the construction of the sliding doors 17R and 17L, which doors are substantially identical except for being mirror images of one another, each door is defined principally by a large plate-like glass pane 81, commonly referred to as a "slab", which is typically of significant thickness and of structural properties to provide requisite safety. The glass slab 81 (FIG. 1) is maintained in an upright orientation and defines thereon an upper edge 82, exposed inner and outer side or upright edges 83 and 84 respectively, and a rail structure 85 (FIG. 1) which is of generally conventional construction and is fixed to and extends horizontally of the door slab adjacent the lower edge thereof. This lower rail structure 85 is generally configured so as to be compatible with the horizontal lower frames 23B provided on the adjacent wall panels 15R and 15L so as to provide a generally continuous look and line of sight.

The glass door slab 81 mounts the right and left roller hanger units 18 thereon adjacent the respective right and left upper corners thereof, which units in FIG. 1 are designated 18-1 and 18-2 so as to designate their positional relationships relative to the respective inner and outer upright door edges 83 and 84 respectively. The roller units associated with each door slab 81 cooperate with the track arrangement 19 which is fixed to and extends horizontally along the upper header or frame structures 23T associated with the adjacent side panels 15R and 15L as well as along the doorway header 25 associated with the door frame 14.

Due to the double width of the doorway 13, and the double doors 17R and 17L which move outwardly into opened positions disposed on opposite sides of the doorway 13, the track arrangement 19 extends horizontally throughout not only the length of the doorway header 25, but also throughout substantially the length of the headers 23T associated with both side panels 15R and 15L. This track arrangement 19 is defined principally by a horizontally elongate support track or rail 86 (FIGS. 6 and 9) which is preferably of metal, such as aluminum, and has a generally L-shaped cross-section defined by an upright vertical leg 87 which at its lower end joins to a horizontally cantilevered bottom leg 88. The vertical leg 87 has a generally flat rear face which overlies and abuts the side face 44 of the respective top trim member 43 or 43A. A plurality of horizontally spaced fasteners 89, such as self-tapping screws, extend through countersunk openings 90 formed in the leg 87 and through aligned openings in the upper tubular part of the trim members 43 and 43A for threaded engagement within openings in the pad which extends along the side leg 52 of the reinforcing beams 32 and 32A. This creates a rigid securement of the support track 86 and the trim members 43 and 43A to the respective reinforcing beams 32 and 32A as associated with the respective doorway frame 14 and side panels 15R and 15L, as shown in FIGS. 6 and 9. When secured, the upper edge of the vertical track leg 87 is disposed at substantially the same elevation as the upper edge of the trim members 43 and 43A to provide elevational continuity of the upper edges of the adjacent panel frames and doorway frame. This also results in the horizontally cantilevered lower leg 88 of track 86 protruding horizontally outwardly away from the top frame or beam at a location disposed vertically between upper and lower edges thereof.

The support track 86 may be defined by a single elongate L-shaped member, but is preferably constructed from two shorter and preferably identical L-shaped members 86R and 86L which are fixedly secured to the panel and doorway header beams in horizontally aligned relationship, with adjacent and substantially abutting ends of the two aligned rail members being disposed substantially at the midpoint of the doorway header 25. This construction enables each of the track members 86R and 86L to be more convenient with respect to manufacture, transportation and assembly, without creating any significant impact with respect to the strength and aesthetics of the overall arrangement.

The lower horizontally cantilevered track leg 88, as illustrated in FIG. 9, protrudes outwardly a sufficient extent away from the header so as to generally overlie the upper edge 82 of the door slab 81, and in the illustrated arrangement this lower track leg 88 terminates in an outer edge surface which is spaced forwardly a small distance from the vertical plane defining the front face of the door slab. The lower track leg 88 defines thereon a generally horizontal upper surface, and a groove 91 opens downwardly from this upper surface and extends lengthwise throughout the length of the track member 86. The groove 91 is positioned inwardly a small distance from the front edge of the lower leg, and preferably has a cross-sectional configuration compatible with the peripheral tread defined on the roller 92 and which is engaged within the groove.

With respect to the construction of the roller hanger units 18 as mounted on the upper corners of each suspended door 15, the construction of these units is described in detail in Assignee's aforementioned co-pending application Ser. No. 11/450,908 so that a full detailed description of the construction of the roller hanger units will not be set forth herein. Rather, only some of the structural and functional aspects of these roller units will be described below with reference to FIGS. 10-11.

More specifically, the roller hanger unit 18 includes a main bracket structure 95 defined by a main hanger bracket 96 and a bottom bracket part 97 which cooperate to effect clamping of the glass slab 81 therebetween as illustrated in FIG. 6.

Figure 10:
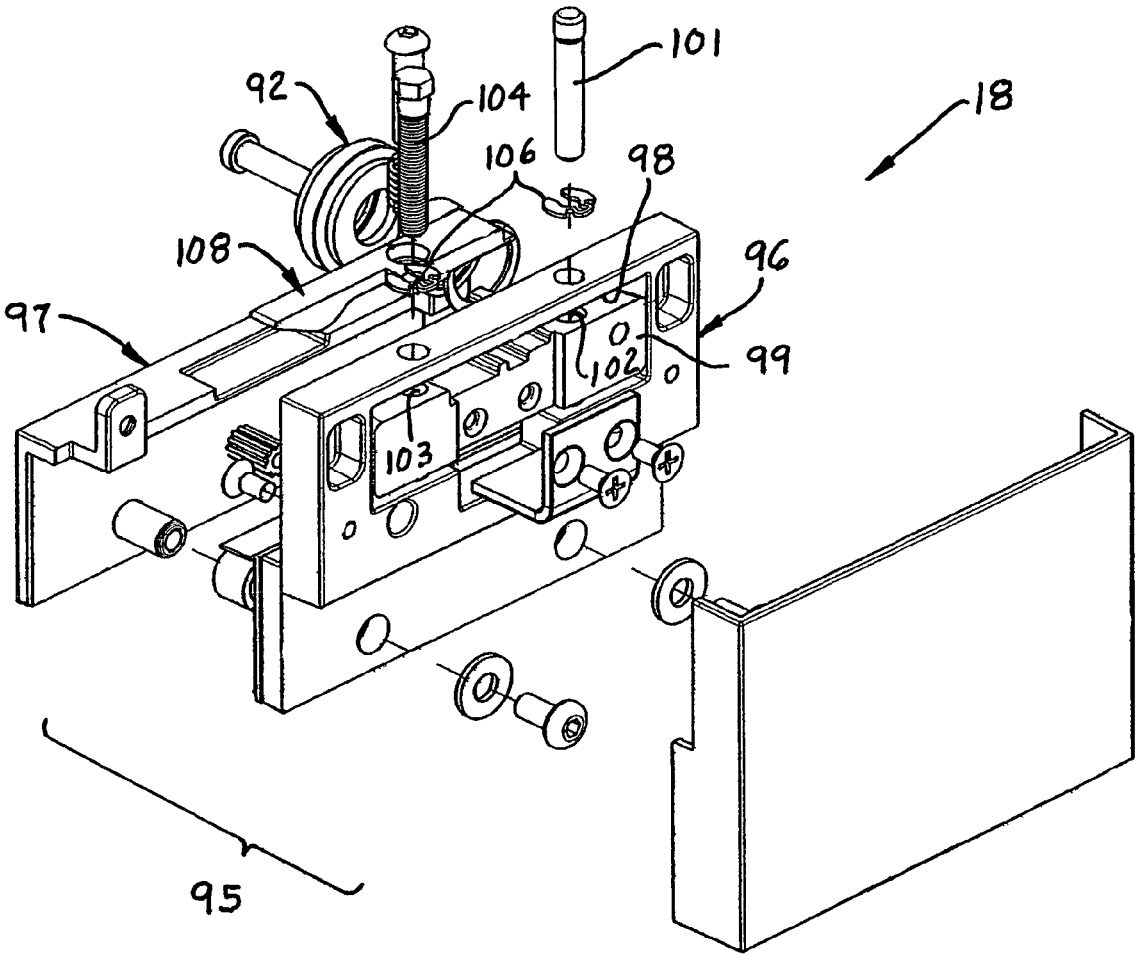
FIG. 10 is an exploded perspective view illustrating the construction of the roller hanger unit which couples to an upper edge of the door for rolling support with the track fixed to the wall.
Figure 11:
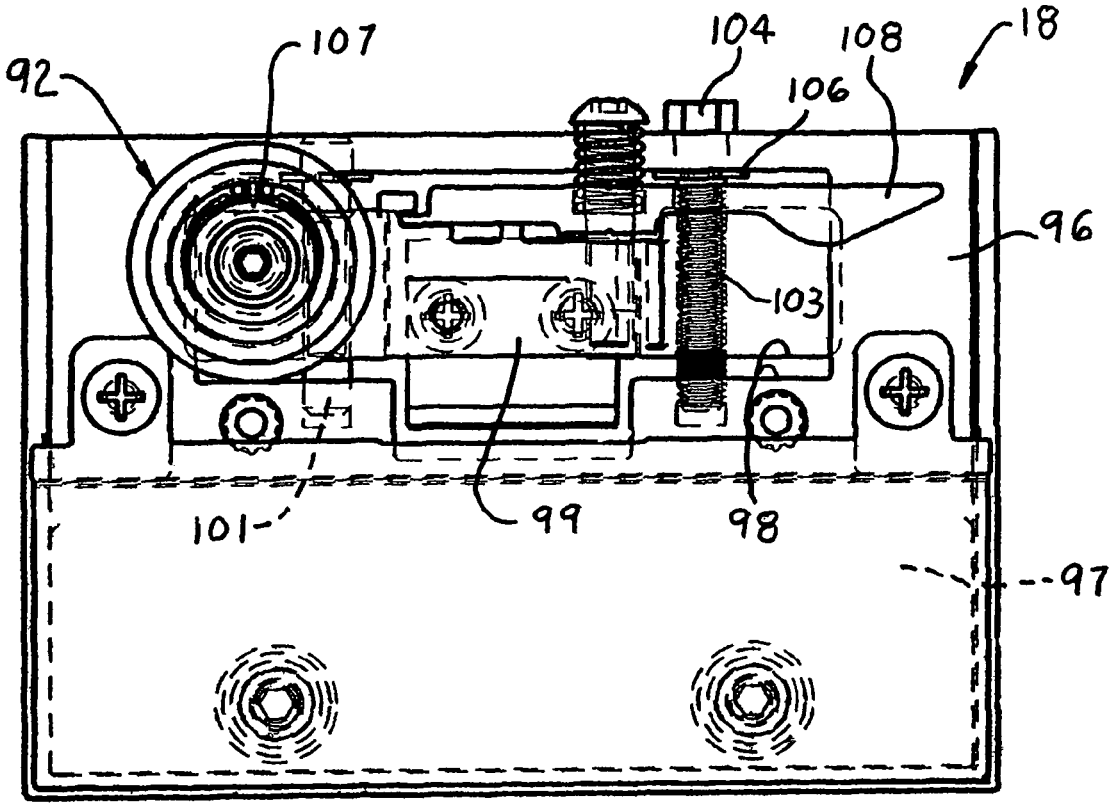
FIG. 11 is a rear elevational view of the roller hanger unit shown in FIG. 10.

The main hanger bracket 96, as illustrated in FIG. 10, has a large and generally rectangular opening 98 extending transversely therethrough between the front and back sides thereof. This opening 98 accommodates therein a roller support bracket 99 which is undersized relative to the opening 98 so as to permit at least limited relative movement therebetween, primarily for initial vertical position adjustability of the roller 92 relative to the upper edge of the door slab, as explained below.

The roller support bracket 99 is supported on the hanger bracket 96 by a vertical guide pin 101 which is stationarily mounted on the hanger bracket 96 and projects transversely (i.e. vertically) across the opening 99 adjacent one end thereof. This guide pin 101 extends through an elongate opening 102 which extends vertically through the block-like end part of the roller support bracket 99 for permitting the roller support bracket 99 to be vertically slidably displaced relative to the hanger bracket 96, to the extent permitted by the vertical clearance or spacing defined between bracket 99 and the opposed upper and lower walls of the opening 98. The other block-like end of roller support bracket 99 has a threaded opening 103 extending vertically therethrough in generally parallel relationship to the opening 102. This threaded opening 103 cooperates with a threaded fastener 104, namely a screw, which extends vertically across the opening 98, and is maintained in threaded engagement with the opening 103 formed in the roller support bracket 99. The head of screw 104 is positioned adjacent the upper surface of the hanger bracket 96 for access by an adjusting tool, and is maintained in this position by a lock clip 106 which engages the body of the screw 104 and is positioned adjacent the upper wall of the opening 98 to prevent vertical displacement of the screw 104. When screw 104 is rotated, its threaded engagement with the roller support bracket 99 enables this bracket, in its entirety, to be vertically slidably displaced a limited extent, either upwardly or downwardly within the clearance provided by the vertical spacing between the opposed upper and lower side walls of the opening 98, so as to permit limited vertical positional adjustment of the roller support bracket 99 relative to the upper edge of the door slab 81.

The roller support bracket 99 has a cylindrical hub 107 formed thereon and protruding horizontally outwardly from the rear side thereof. This hub 107 rotatably supports thereon the roller or wheel 92, whereby this roller is rotatable about a generally horizontal axis which projects transverse (i.e. perpendicular) to the front face of the door slab 81. The roller 92, due to its support on the rearwardly cantilevered hub 107, is positioned generally directly over the upper edge of the glass slab 81, and is spaced a small and defined distance above the upper edge of the glass slab so as to permit the lower track leg 88 to project into the vertical space between the roller 92 and the upper edge of the glass door slab, whereby the roller 92 can be disposed in rolling engagement with the elongate track groove 91.

In the preferred construction the roller 92 has a generally cylindrical exterior tread configuration which closely conforms to the cross-sectional configuration of the groove 91 formed in the lower track leg 88 so that the roller 92, when engaged within the groove 91, is closely sidewardly confined to restrict the roller 92 solely for rolling movement in the lengthwise direction of the groove 91.

Each roller hanger unit 18 also preferably mounts thereon a stopper member 108 positioned for cooperation with one of a plurality of stoppers 109 which are affixed to the L-shaped track 86 at selected locations for defining the limit positions of each door, namely the fully closed and fully opened positions of each door.

With the adjustability provided by the construction of the roller hanger units 18, which adjustability only requires that the threaded screw 104 be rotated so as to adjust the vertical height of the roller 92 relative to the upper edge of its respective door slab, the rollers associated with the two roller hanger units 18-1 and 18-2 as associated with each door can be independently adjusted to achieve the desired positioning and suspension of the door from the track 86 during initial installation of the door on the track. This independent adjustability of the rollers associated with the hanger units 18-1 and 18-2 can hence be utilized to adjust the suspended position of the respective door when it is in its fully opened position, namely when it is supported on the section of the track 86 which is fixed to the respective wall panel 15R or 15L, so as to at least partially offset or compensate for the downward deflection of the pre-tensioned doorway header 25 when the latter is loaded by the doors when in a closed position, as explained hereinafter.

The track 86, and more specifically the pair of track members 86R and 86L are secured to the pre-tensioned doorway beam 25 in a manner so as to ensure that the section of track member which attaches to the beam 25 also assumes the same deflected curvature as the beam. As one exemplary process for achieving this result, the side wall of the reinforcing beam 32 associated with the doorway header beam 25 has a plurality of openings 93 pre-drilled therein at spaced locations therealong, and corresponding countersunk openings 90 are pre-drilled at corresponding locations along the upright leg of each track member 86. After the support beam 25 has been assembled in the factory, then the track member such as 86R or 86L is initially fixedly attached to the beam 25 by means of the screws 89 which are extended through the openings 90 in the track member and threadably engaged within the openings 93 formed in the side wall of the reinforcing beam 32. Due to the pre-drilling of these openings, and the manner in which the screws 89 are provided with tapered heads which seat within the countersunk openings 90, the portion of the track member which overlaps and is coupled to the pre-tensioned beam 25 is deformed so as to assume generally the same curvature as the beam 25.

After the track members have been assembled to the doorway beam 25, and the beam 25 and its door frame have been assembled between the adjacent upright wall sections, then the portions of the tracks which cantilever outwardly from opposite ends of the pre-tensioned doorway beam 25 are positioned so as to overlie the frame header 23T of the adjacent wall section. These protruding rail sections are appropriately manipulated and deflected if necessary so as to extend horizontally along the upper frame header 23T. When so horizontally positioned, the track protrusion is clamped relative to the frame header 23T. The countersunk openings 90 formed in the protruding track portion are then used as pilots to permit forming of openings 93 through the leg 52A of the reinforcing beam 32A. The screws 89 are then inserted through the countersunk openings 90 and tapped into the openings 93 to hence rigidly secure the track to the top beam 23T, following which the clamps are removed. The self-tapping screws 89 may themselves be used to effect formation of openings through trim member 43A and beam leg 52A.

With the above mounting technique, the portions of the tracks which overlap and are rigidly secured to the frame headers 23T hence extend horizontally, with these portions then being smoothly merged into the upwardly deflected track portions which are fixedly adhered to the pre-tensioned doorway header 25.

With the aforementioned construction, namely forming the track 86 from two identical track members 86R and 86L which effectively abut at the midpoint of the doorway header beam, the rollers associated with each track member hence are maintained in rolling engagement with a continuous track surface throughout the movement of the rollers as the door moves between open and closed positions, thereby enhancing and facilitating smooth opening and closing movement of the doors. The creation of abutting joints along the roller path is hence avoided.

While the construction of the wall system and the corresponding double door arrangement, and the operation of the doors, is believed self-evident from the descriptions presented above, nevertheless the following will describe positional and dimensional relationships in accordance with one preferred overall arrangement, and specifically the manner in which these positional and dimensional relationships, as they relate to the pre-stressed doorway header 25 and door roller hanger brackets 18-1 and 18-2, effect the positional relationships of the suspended doors 15R and 15L when in both the fully opened and fully closed positions.

In the double-width door arrangement of the present invention, the door opening 13 will normally be of generally conventional height, which height will typically be in the range of about eight feet to about ten feet, with the overall height of the wall system typically being about nine to eleven feet. The width of the door opening 13, however, in comparison to a conventional doorway of three foot to four foot width, instead is of double width so that the door opening width is typically about eight feet, whereby the door opening cooperates with a pair of doors each having a width in the range of about four feet. The width of the door opening hence is of generally the same magnitude as the door opening height.

Figure 12:
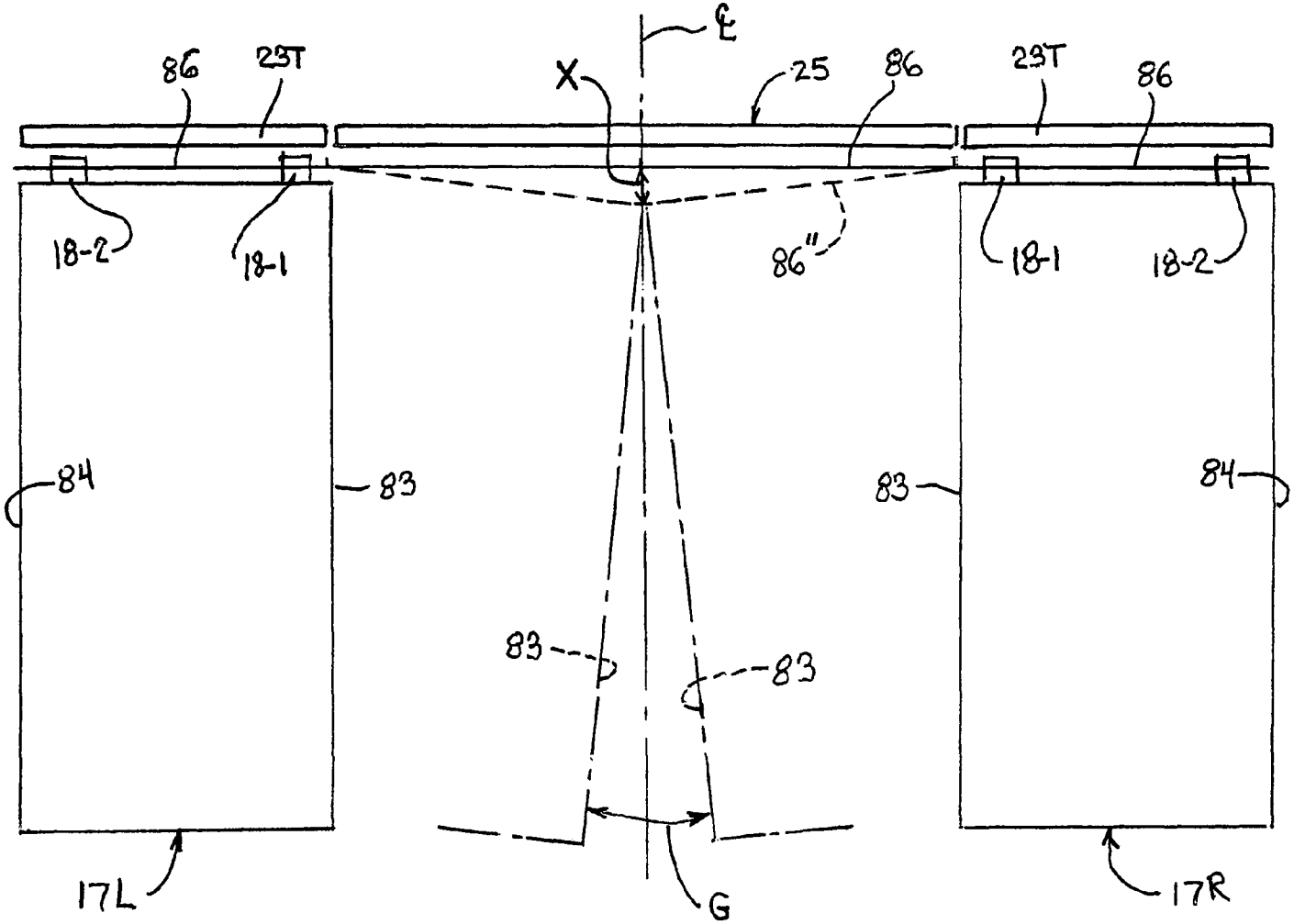
FIG. 12 is a diagrammatic view which illustrates, on an exaggerated scale, the deflection of the doorway header when loaded by the doors in the closed position.
Figure 13:
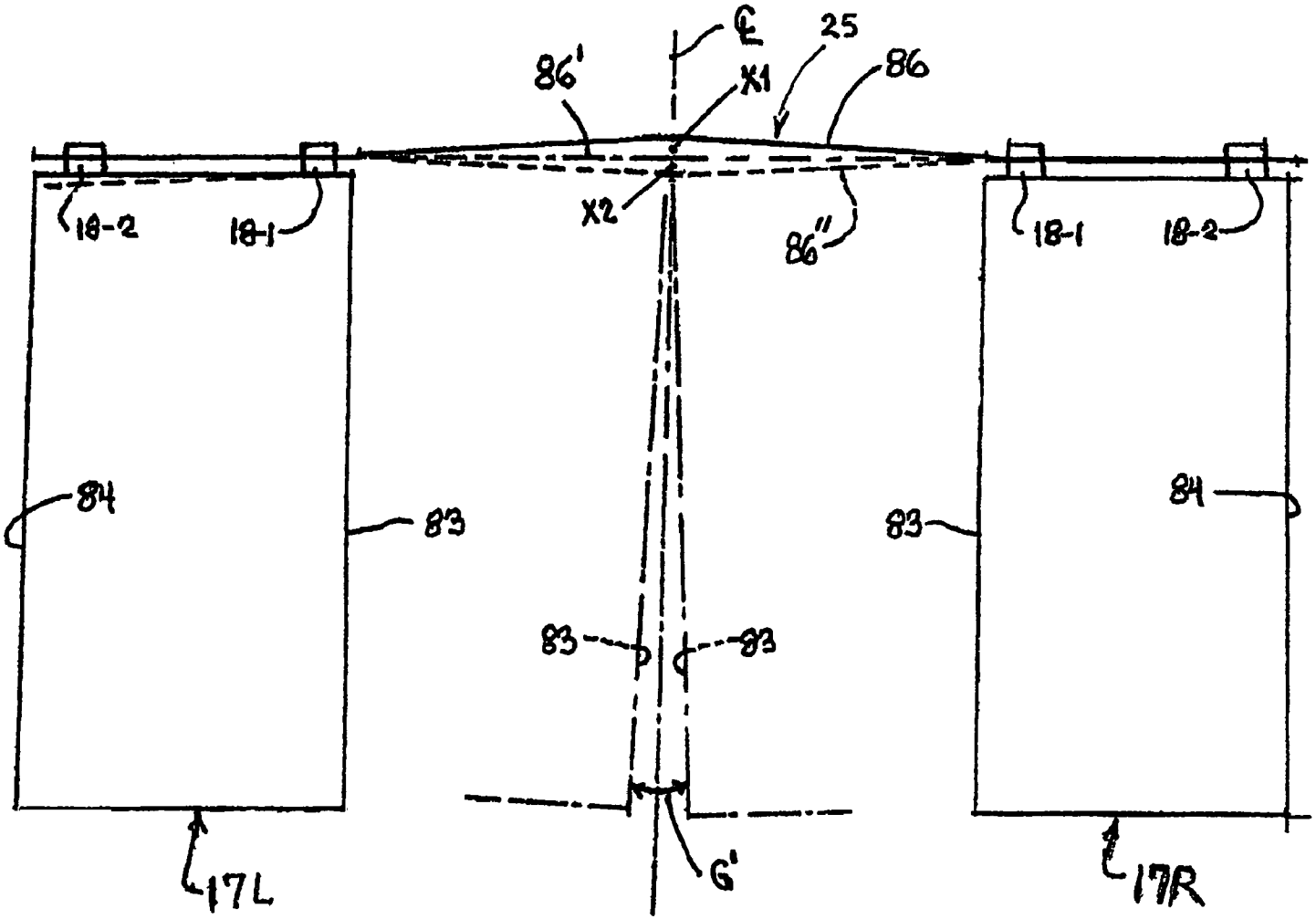
FIGS. 13 and 14 are further diagrammatic views similar to FIG. 12 but illustrating the beam deflection, and its effect on the closed doors, in accordance with the present invention.
Figure 14:
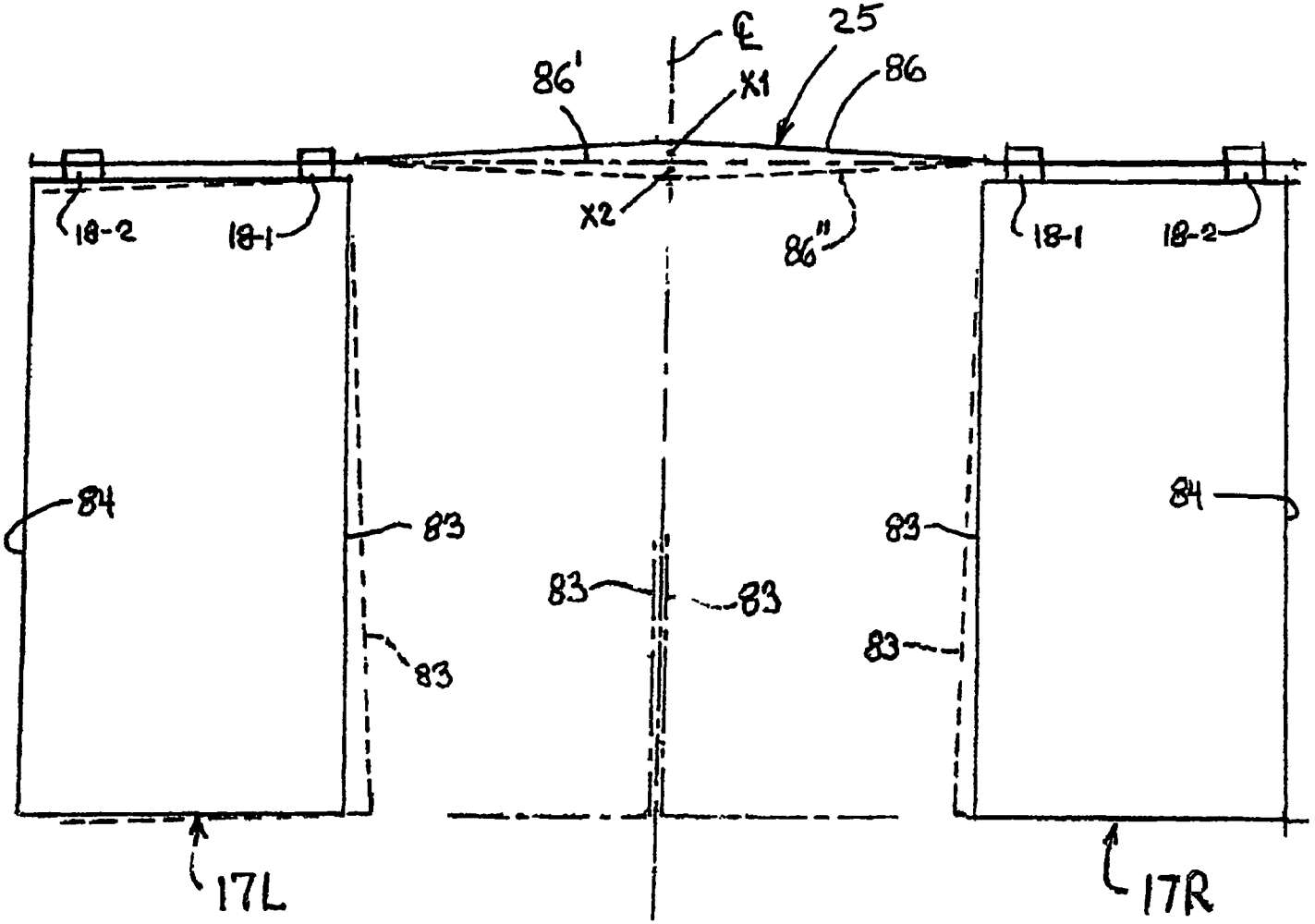

Referring now to FIGS. 12-14, there is diagrammatically illustrated various positional relationships experienced by the double doors 17R and 17L when in the open and closed positions, as caused by vertical downward deflection of the top door header beam 25 when under load.

As a basic illustration of the header beam deflection and positional relationships of the doors caused by such deflection, FIG. 12 diagrammatically illustrates the pair of doors 17R and 17L in their open position, with the doors suspended from the support track 86 so that the door inner side edges 83 project vertically downwardly in generally parallel relationship. Assuming that the doorway header beam and the track (as diagrammatically indicated by the solid line 25) is straight and non-deflected when in a non-loaded condition (i.e. the doors in a open position), the movement of the doors into the closed position and the imposition of the weight of the doors on the track 86 and beam 25 causes the doorway header beam and track to vertically deflect downwardly and hence assume a downwardly bowed configuration substantially as indicated by the dotted line 86", with the center point of the beam being vertically deflected downwardly from a straight non-loaded position by a distance designated "X". Due to this downward deflection of the beam 25 under load, the innermost roller support units 18-1 are positioned at a slightly lower elevation than the outer roller support units 18-2, thereby causing the doors in the closed position to swing outwardly with a clamshell-like motion about their upper inner roller support units 18-1, thereby causing the closely adjacent inner side edges 83 to be angled in diverging relationship to one another as they project downwardly, as indicated by dash-dot lines, thereby creating a gap G therebetween which is widest adjacent the lower edges of the doors. The size of gap G is obviously directly related to the magnitude of the downward deflection X. Such gap G and its width irregularity is readily noticeable and hence severely impacts the aesthetics of the wall system.

To minimize or eliminate the gap created when the straight door header beam 25 is deflected downwardly under load as illustrated by FIG. 12, the beam 25 of the present invention is preferably pre-tensioned so that the door header beam 25 and the track 86 mounted thereon assume an upward bowed configuration, as indicated by the solid line 86 in FIG. 13, when the doors 17R and 17L are in the open position and the door header beam 25 is not externally loaded. The upward deflection of the beam 25 and track 86 at the midpoint, due to pre-tensioning of the beam, is a distance X1 (FIG. 13) above the non-pre-stressed straight line condition of the beam if it was not pre-stressed, this latter condition being represented by the dash-dot line 86'. The doors 17R and 17L, when in the open position as illustrated in FIG. 13, are suspended so that the inner vertical edges 83 extend vertically downwardly in generally parallel relationship to one another. Movement of the doors into the closed position, however, causes the doorway header beam 25 and its track 86 to deflect downwardly a sufficient extent so that the beam and track not only move downwardly to but passes vertically downwardly beyond the straight position 86', whereupon the doorway beam and track assumes a downwardly bowed configuration as depicted by the dotted line 86". The downward deflection or displacement of the midpoint of the beam, due to loading thereof by the doors, hence is the total of the upward pre-stressing displacement X1 combined with the additional displacement X2 which extends downwardly from the straight position 86' to the downwardly deflected position 86". In this situation, the closely adjacent and opposed inner side edges 83 of the doors again swing slightly outwardly away from one another generally about the upper inner corners of the doors and create a gap G' therebetween, which gap is widest adjacent the lower edges of the door. However, since the total load-induced deflection of the doorway header beam 25 and its track in the pre-tensioned beam arrangement illustrated by FIG. 13 is the sum of the upward and downward deflections X1 and X2, the total of which equals the downward displacement X in the non-prestressed beam of FIG. 12, the width of gap G1 in the pre-tensioned arrangement of FIG. 13 is significantly smaller than the width of gap G created in the non-pretensioned arrangement of FIG. 12. The pre-tensioned beam arrangement of FIG. 13 hence significantly minimizes the gap between the adjacent inner edges of the doors when in the closed position, and hence provides an overall door arrangement having significantly improved aesthetics.

The arrangement employing a pre-tensioned doorway header beam 25 as diagrammatically illustrated in FIG. 13 is particularly desirable since the pre-stressing of the beam is preferably selected to cause an upward deflection of the unloaded beam by a displacement distance X1 which is preferably less than the total displacement distance X (which is the sum of the distances X1 plus X2), with the pre-tensioning displacement X1 preferably being in the range of about 40 percent to about 60 percent, and preferably about 50 percent, of the total beam deflection X resulting from loading imposed on the header beam by the doors when in the closed position. This relationship is believed desirable since it minimizes the deflection or distortion of the beam from its straight condition so as to maintain desirable aesthetics when the beam is unloaded and the doors are in the open position, and at the same time these relationships minimize the tendency of the doors in a closed position to clamshell-like swing away from one another and thus minimizes any gap which is created between the opposed inner door edges when in a closed position.

With the door header beam 25 provided with a composite beam construction corresponding generally to the arrangement illustrated and described herein, it has been determined that such beam, when associated with an eight foot wide doorway and cooperating with a pair of four foot wide glass slab doors, may experience a downward deflection of about six millimeters due to loading of the beam caused by movement of the glass doors into the closed position. By initially pre-tensioning the beam 25 so as to effect upward bowing thereof as illustrated in FIG. 13 to cause an upward displacement X1 of about three millimeters, the loading of the beam when the doors are in the closed position causes the beam to be bowed downwardly whereby the center point is deflected downwardly by the combined distances X1 and X2. Since the total downward deflection of the beam due to the door load is about six millimeters, the downward displacement X2 will be about three millimeters. The beam hence assumes an upwardly bowed or deflected configuration in a pre-stressed but non-loaded condition, with the beam then reversely deflecting so as to assume a downwardly bowed configuration when fully loaded, with the downwardly bowed configuration being generally the same curvature and magnitude as the unloaded but pre-tensioned upwardly bowed configuration.

While the above-described arrangement represents a significant improvement with respect to positional aesthetics of the door arrangement when the doors are in the closed position, still further improvements can be effected by additionally positionally adjusting one or both of the roller hanger units 18-1 and 18-2 as associated with each door. In this regard, in addition to pre-tensioning of the doorway beam as described above and as illustrated in FIG. 13, the doors 17R and 17L are themselves initially positionally adjusted when in the open position so that the inner edges 83 thereof, rather than being suspended in parallel relationship, are instead positioned so as to be slightly angled inwardly toward one another as these edges protrude downwardly, as diagrammatically illustrated by the dash line edges 83 in FIG. 14. This is accomplished by adjusting the height of the roller associated with one or both of the roller units 18-1 and 18-2 so that the vertical spacing between the roller and upper door slab edge at the roller unit 18-1 is less than the vertical spacing between the roller and upper door slab edge at the outer roller unit 18-2. This causes the doors when in the open position to be suspended in a slightly angled or skewed relationship, as diagrammatically illustrated in FIG. 14 by the dotted lines representing the inner edges 83. However, when the doors are moved toward the closed position, the beam 25 deflects downwardly into the downwardly deflected condition indicated by the dotted line 86", which in turn causes the doors to swing outwardly away from one another generally about their upper inner roller units in the same manner as described above relative to FIG. 13. This outward swinging of the doors away from one another, as the doors move into the closed position, hence compensates for or counteracts the initial skewed position of the doors when in the open position as shown in FIG. 14. The net result is that the doors in their closed position can be disposed in closely adjacent and generally parallel relationship. The irregular gap between the adjacent inner edges of the doors when in the closed position is hence avoided, and the overall aesthetics of the closed door arrangement are greatly improved.

With the arrangement of FIG. 14, the initial pre-tensioning of the beam 25 to effect initial upward bowing thereof hence partially compensates for beam deflection caused by loading of the beam by the doors when in a closed position, and the initial slightly skewed positioning of the doors when in the open position compensates for the remainder of the beam deflection caused by door loading when the doors are in the closed position, whereby the closed doors can be supported in a desired vertically suspended relationship so that the closely adjacent inner edges 83, as indicated by dash-dot lines in FIG. 14, define a narrow and substantially uniform width gap therebetween throughout the height thereof.

While the doorway beam 25 of the present invention and its cooperation with a pair of glass doors has been observed to create a maximum downward beam deflection of about six millimeters when the doors are in the fully closed position, and it has been determined that with this arrangement the pre-stressing of the beam is most desirably selected so as to cause an initial upward bowing of the beam to create a maximum upward deflection of about three millimeters when the beam is not loaded by the doors, it will be appreciated that other deflection magnitudes and other ratios of pre-tensioned deflection versus maximum load deflection may be desirable, depending upon the finalized design of the beam and the manner and magnitude of load imposed thereon.

As a matter of clarification, and referring to FIG. 8, the pre-tensioned door header beam 25 can, if desired, be provided with a top-of-wall horizontal lateral support arrangement 111 adjacent one or both of the free ends thereof. Such arrangement in the illustrated embodiment includes a channel-shaped mounting bracket 112 which is seated on and protrudes upwardly from the base wall 51 of the reinforcing beam 32, and is fixed thereto by fasteners such as screws. This bracket at one end thereof mounts a transversely-extending support pin which effectively functions as a pivot in that it pivotally supports the lower end of a lateral support member 114. This lateral support member 114 is defined generally as a lever which is swingable vertically upwardly about the support pin 113, with the lateral support member 114 being normally biased into a generally upward orientation by a suitable spring 115. The lateral support member 114 is biased upwardly so that the free end thereof will protrude into the interior of a downwardly-opening elongate channel which is secured to a ceiling, with the ceiling channel being generally elongated parallel to the upper edge of the wall system. The protrusion of the upper end of the lateral support member 114 into the channel hence provides some horizontal lateral (i.e. sideward) restraint to the upper edge of the upright wall. Such lateral restraint arrangements are known, and further description thereof is believed unnecessary. When such arrangement is provided on the pre-tensioned beam, then the upper frame beam 33 is somewhat shortened in length so as to provide sufficient space to accommodate the lateral support arrangement 111 substantially as illustrated by FIG. 8.

With the improved pre-tensioned doorway header beam 25 of this invention, the overall height of the doorway header beam can be maintained at a reasonably small magnitude, such as four inches or less, thereby permitting uniform and minimal height of both the panel and doorway headers, and providing improved aesthetics.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An upright interior wall structure disposed in supportive engagement on a floor, comprising:

right and left upright wall sections disposed in supportive engagement on a floor;

each said wall section including a frame structure having a horizontally elongate top frame structure extending along an upper edge thereof;

an inverted U-shaped door frame defining a double-wide door opening extending transversely therethrough, said door frame including right and left upward side frame members disposed in sidewardly spaced relation and defining said double-wide door opening therebetween, and an elongate header structure extending horizontally between and rigidly joined to upper ends of the right and left side frame members for defining an upper extremity of said door opening;

said door frame being positioned sidewardly between and structurally joined to said right and left wall sections in horizontally aligned relation so that the upper header structure is disposed in adjacent end-to-end relationship between the top frame structures associated with the respective right and left wall sections;

a horizontally elongate support track fixed to and extending horizontally along said upper header structure and said top frame structures associated with said right and left wall sections;

right and left sliding doors positioned laterally adjacent one side of said wall structure and suspended vertically from said support track and movable horizontally therealong between (1) a closed position wherein said doors are disposed in directly sidewardly adjacent relationship and overlie and close-off the door opening and (2) an open position wherein the right and left doors are disposed in sidewardly spaced relationship and primarily overlie an exterior side face of the respective right and left wall sections;

said right and left doors each mounting thereon, adjacent opposite upper corners thereof, a pair of roller-hanger units each having a roller positioned in rolling engagement with the support track so that the doors can be horizontally displaced between said closed and open positions; and a pre-tensioning arrangement mounted on and extending lengthwise along said upper header structure for causing said header structure, when free of external loading, to be deflected upwardly into an upwardly bowed shape, said pre-tensioning arrangement causing the header structure at a midpoint thereof to be deflected upwardly through only a small distance relative to the ends of the header beam;

whereby movement of the right and left doors into the closed position and the imposition of the doors weight through the rollers onto the support track causes the pre-tensioned upwardly-bowed header structure to deflect downwardly so as to maintain a more uniform narrow gap between opposed upright inner edges of the closed doors throughout the vertical extent thereof.

2. A wall structure according to claim 1, wherein each said door is defined principally by a large plate-like glass slab.

3. A wall structure according to claim 1, wherein the support track comprises a horizontally-elongate support rail having a generally L-shaped cross-section and extending along solely the top frame structures of the right and left wall sections and the upper header structure of the door frame.

4. A wall structure according to claim 1, wherein the roller hanger unit includes a vertical adjustment structure which permits the position of the roller to be vertically adjusted relative to the door when the roller hanger unit is mounted to the door;

wherein the vertical positions of the rollers associated with the door are vertically adjusted so that one of the rollers is spaced vertically a greater distance from the door than the other roller, whereby the door as suspended from the track when in an open position is suspended downwardly in a small angularly skewed position whereby the upright inner edge of the door is slightly angled inwardly toward the door opening; and wherein the downward deflection of the pre-tensioned upwardly-bowed header structure as the doors move into the closed position causes the doors to slightly swing outwardly away from one another to permit the opposed inner edges of the doors when in the closed position to be disposed in closely adjacent uniform relationship throughout the height of the doors.

5. A wall structure according to claim 1, wherein each of said top frame structures and said header structure is defined by a main horizontally-elongate top header member having a generally tubular cross-section and having a pair of horizontally elongate top trim members fixed thereto and protruding upwardly from adjacent opposite sides thereof to define a generally channel-shaped cross-section, and a horizontally elongate reinforcing beam positioned interiorly of and extending lengthwise along said top header member throughout substantially the entire length thereof, said reinforcing beam being positioned sidewardly between the top trim members and seated on and rigidly joined to the respective top header member; and said pre-tensioning structure being positioned interiorly of and extending lengthwise along said top header member associated with solely said upper header structure for imposing a lengthwise compressive force on said top header member to cause said upper header structure to deflect into the upwardly-bowed shape.

6. A wall structure according to claim 5, wherein the pre-tensioning structure includes an elongate tension rod positioned within and extending lengthwise along said top header member, said rod being pre-tensioned and adjacent opposite ends thereof being interconnected to said top header member, said header structure having a lengthwise-extending centroid which is positioned in upwardly spaced relation from said pre-tensioned rod, and said pre-tensioned rod adjacent opposite ends thereof applying a lengthwise-directed compression force to said top header member to cause said header structure to assume the upwardly bowed shape.

7. A wall system according to claim 6, wherein said pre-tensioning structure includes a horizontally elongate frame tube which is positioned within and extends lengthwise of said top header member and which surrounds said pre-tensioned rod along most of the length thereof, said pre-tensioned rod having threaded nuts engaged with opposite end portions thereof, said nuts being disposed in abutting engagement with abutment plates which bear against opposite ends of said frame tube to apply compressive force thereto when the rod is pre-tensioned, and said frame tube being rigidly joined to said top header member along the length thereof to cause upward bowing thereof responsive to the pre-tensioning force developed in the tension rod.

8. A sliding glass door arrangement for cooperation with a wall, comprising a double-wide door opening formed in an upright wall, a horizontally-elongate top header beam extending across and defining the upper extremity of said door opening, a pre-tensioning arrangement mounted on and extending lengthwise of said top header beam for causing the header beam, between the horizontally spaced ends thereof, to be deflected upwardly into a shallow bowed shape, a support track fixed to and extending lengthwise of said top header beam and also extending generally horizontally for predetermined distance along and rigidly fixed to said wall adjacent both right and left sides of the door opening, right and left glass slab doors supported on and vertically suspended downwardly from said track so that the doors are disposed in generally sidewardly co-planar relationship and are positioned to laterally overlap one exterior side face of said wall, said doors being movable along said track between (1) a closed position wherein the doors are positioned directly sidewardly adjacent one another and overlie and close-off the door opening and (2) an open position wherein the doors are sidewardly spaced apart so as to uncover the door opening and are positioned so as to laterally overlap the wall adjacent the respective right and left sides of the door opening, the doors when in said closed position effecting vertical downward loading of the top header beam which causes said header beam to downwardly deflect away from the upwardly bowed shape so as to minimize outward relative swinging between opposed inner edges of the doors when in said closed position.

9. A door arrangement according to claim 8, wherein a pair of roller-type hanger units are mounted on each door adjacent upper corners thereof and engaged in rolling and supportive engagement with said track, at least one of said units on each said door having a vertical height adjustment structure for permitting the vertical position of the roller to be adjusted with respect to the door, and at least one of the rollers associated with each door being vertically adjusted relative to the other roller on the same door so that the door when suspended from the track in the open position assumes a small sidewardly skewed angular orientation causing the upright inner edge of the door to be slightly angled inwardly toward the door opening as the inner edge projects downwardly, whereby this skewed positioning of the doors in the open position compensates for deflection of the top header beam into a shallow downwardly bowed configuration due to external loading of the header beam caused by movement of the doors into the closed position.

* * * * *